United States Patent [19]

Terauchi

[11] Patent Number: 5,027,612

[45] Date of Patent: Jul. 2, 1991

[54] REFRIGERATING SYSTEM HAVING A COMPRESSOR WITH AN INTERNALLY AND EXTERNALLY CONTROLLED VARIABLE DISPLACEMENT MECHANISM

[75] Inventor: Kiyoshi Terauchi, Isesaki, Japan

[73] Assignee: Sanden Corporation, Gunma, Japan

[21] Appl. No.: 404,594

[22] Filed: Sep. 8, 1989

Related U.S. Application Data

[63] Continuation of Ser. No. 247,605, Sep. 22, 1988, Pat. No. 4,882,909.

[51] Int. Cl.[5] ..... F25B 41/00

[52] U.S. Cl. ..... 62/212; 62/227; 62/228.5; 417/270

[58] Field of Search ..... 62/227, 228.5, 209, 62/212; 417/270, 222

[56] References Cited

U.S. PATENT DOCUMENTS

| | | | |
|---|---|---|---|
| 3,047,696 | 12/1159 | Heidorn | 200/140 |
| 2,573,863 | 11/1951 | Mitchell | 417/222 |
| 3,698,204 | 10/1972 | Schlotterbeck et al. | 62/228.5 |
| 3,810,488 | 5/1974 | Orth et al. | 62/217 |
| 4,037,993 | 7/1977 | Roberts | 417/222 |
| 4,231,713 | 11/1980 | Widdowson et al. | 417/222 |
| 4,428,718 | 1/1984 | Skinner | 417/222 |
| 4,526,516 | 7/1985 | Swain et al. | 417/222 |
| 4,533,299 | 8/1985 | Swain et al. | 417/222 |
| 4,539,823 | 9/1985 | Nishi et al. | 417/222 |
| 4,557,670 | 12/1985 | Inagaki et al. | 417/299 |
| 4,563,878 | 1/1986 | Baglione | 62/115 |
| 4,586,874 | 5/1986 | Hiraga et al. | 417/222 |
| 4,606,705 | 8/1986 | Parekh | 417/222 |
| 4,632,640 | 12/1986 | Terauchi | 417/269 |
| 4,664,604 | 5/1987 | Terauchi | 417/222 |
| 4,669,272 | 6/1987 | Kawai et al. | 62/220.3 |
| 4,685,866 | 8/1987 | Takenaka et al. | 417/222 |
| 4,687,419 | 8/1987 | Suzuki et al. | 417/222 |
| 4,688,997 | 8/1987 | Suzuki et al. | 417/222 |
| 4,702,677 | 10/1987 | Takenaka et al. | 417/222 |
| 4,730,986 | 3/1988 | Kayuhawa et al. | 417/222 |
| 4,747,753 | 5/1988 | Taguchi | 417/222 |
| 4,778,348 | 10/1988 | Kikuchi et al. | 417/222 |
| 4,780,059 | 10/1988 | Taguchi | 417/222 |
| 4,780,060 | 10/1988 | Terauchi | 417/222 |
| 4,842,488 | 6/1989 | Terauchi | 417/222 |

FOREIGN PATENT DOCUMENTS

| | | |
|---|---|---|
| 219283 | 10/1985 | European Pat. Off. . |
| 190013 | 1/1986 | European Pat. Off. . |
| 257784 | 7/1987 | European Pat. Off. . |
| 287940 | 4/1988 | European Pat. Off. . |
| 3500299 | 1/1985 | Fed. Rep. of Germany . |
| 3603931 | 2/1985 | Fed. Rep. of Germany . |
| 3731944 | 6/1985 | Fed. Rep. of Germany . |
| 56-77578 | 6/1981 | Japan . |
| 58-158382 | 9/1983 | Japan . |
| 59-51181 | 3/1984 | Japan . |
| 61-55380 | 3/1986 | Japan . |
| 62-87679 | 4/1987 | Japan . |
| 2153922 | 2/1984 | United Kingdom . |
| 2155116 | 9/1985 | United Kingdom . |

*Primary Examiner*—William E. Wayner

*Attorney, Agent, or Firm*—Banner, Birch, McKie & Beckett

[57] ABSTRACT

A refrigerating system including a refrigerant circuit having a condenser, evaporator and wobble plate type compressor with a variable displacement mechanism. Two passages communicate between the crank chamber and the suction chamber in the cylinder block. A bellows is disposed in a first passage and controls the communication between the crank chamber and the suction chamber response to crank chamber pressure. A control valve is disposed in the second passage and controls communication between the crank chamber and the suction chamber in the second passage in response to a signal generated outside of the compressor. A control circuit controls the generation of the signal in response to thermodynamic characteristics related to the evaporator. The signal activates or deactivates the second control valve when the characteristic indicates a value beyond a predetermined range of values. This configuration enables the compressor to obtain better cool down characteristics in the passenger compartment of an automobile.

1 Claim, 7 Drawing Sheets

REFRIGERATING SYSTEM HAVING A COMPRESSOR WITH AN INTERNALLY AND EXTERNALLY CONTROLLED VARIABLE DISPLACEMENT MECHANISM

This application is a continuation of application Ser. No. 07/247,605, filed Sept. 22, 1988 now U.S. Pat. No. 4,882,909.

TECHNICAL FIELD

The present invention relates to an improved automotive air conditioning system. More particularly, the present invention relates to a refrigerating system having a slant plate type compressor with an internally and externally controlled variable displacement mechanism suitable for use in an automotive air conditioning system. The present invention also relates to a method for varying the displacement of a slant plate type compressor..

BACKGROUND OF THE INVENTION

One construction of a slant plate type compressor, particularly a wobble plate compressor, with a variable capacity mechanism which is suitable for use in an automotive air conditioner is disclosed in U.S. Pat. No. 3,861,829 issued to Roberts et al. Roberts et al. '829 discloses a wobble plate type compressor which has a cam rotor driving device to drive a plurality of pistons. The slant or incline angle of the slant surface of the wobble plate is varied to change the stroke length of the pistons which changes the displacement of the compressor. Changing the incline angle of the wobble plate is effected by changing the pressure difference between the suction chamber and the crank chamber in which the driving device is located.

In such a prior art compressor, the slant angle of the slant surface is controlled by the pressure in the crank chamber. Typically this control occurs in the following manner. The crank chamber communicates with the suction chamber through an aperture and the opening and closing of the aperture is controlled by a valve mechanism. The valve mechanism generally includes a bellows element and a needle valve, and is located in the suction chamber so that the bellows element operates in accordance with changes in the suction chamber pressure.

In the above compressor, the pressure of the suction chamber is compared with a predetermined value by the valve mechanism. However, When the predetermined value is below a certain critical value, there is a possibility of frost forming on the evaporator in the refrigerant circuit. Thus, the predetermined value is usually set higher than the critical value to prevent frost from forming on the evaporator.

However, since suction pressure above this critical value are higher than the pressure in the suction chamber when the compressor operates at maximum capacity, the cooling characteristics of the compressor are inferior to those of the same compressor without a variable displacement mechanism.

Roberts et al. '829 discloses a capacity adjusting mechanism used in a wobble plate type compressor. As is typical in this type of compressor, the wobble plate is disposed at a slant or incline angle relative to the drive axis, nutates but does not rotate, and drivingly couples the pistons to the drive source. This type of capacity adjusting mechanism, using selective fluid communication between the crank chamber and the suction chamber can be used in any type of compressor when uses a slanted plate or surface in the drive mechanism. For example, U.S. Pat. No. 4,664,604 issued to Terauchi discloses this type of capacity adjusting mechanism in a swash plate type compressor. The swash plate, like the wobble plate, is disposed at a slant angle and drivingly couples the pistons to the drive source. However, while the wobble plate only nutates, the swash plate both nutates and rotates. The term slant plate type compressor will therefore be used to refer to any type of compressor, including wobble and swash plate types, which use a slanted plate or surface in the drive mechanism.

A signal controlled compressor solenoid valve in combination with a pressure actuated bellows valve is disclosed in U.S. Pat. No. 4,778,348 which corresponds to Japanese Utility Model Application No. 61-111994 to improve cooling characteristics and temperature control in the passenger compartment.

In a starting so-called "cool down" stage of an air conditioning system including such a compressor for initially cooling the passenger compartment, the second valve control device works to connect the crank chamber to the suction chamber due to a heat load on the evaporator of the air conditioning system being exceedingly above a single predetermined value. Once the heat load drops to the same predetermined value, the second valve control device closes the valve and only may reopen the valve if the heat load exceeds that single predetermined value which will normally only occur after the air conditioning system has been turned off and then restarted after a certain time period. Once the second valve control device closes the second valve, the first valve control device solely controls the capacity of the compressor.

The air conditioning system including the above mentioned variable displacement mechanism has no problem in a "cool down" stage when cooling recirculated room air.

However, in a "cool down" stage with fresh air intake, i.e., cooling fresh air which is brought into the room, the above mentioned air conditioning system has certain drawbacks.

Referring to FIG. 9, the cool down characteristic of the prior art air conditioning system in a fresh air intake situation is shown. In FIG. 9, a solid line, a dotted line and a dashed line show pressure of an evaporator outlet portion, pressure of a compressor suction chamber and a room (passenger compartment) temperature, respectively. In the cool down stage, the second valve control device works to connect the crank chamber to the suction chamber causing maximum displacement of the slant plate of a slant plate type compressor, so that the room temperature, the pressure in evaporator outlet portion and the pressure in the suction chamber fall quickly. When the pressure in the evaporator outlet portion falls to the single predetermined value P1 that is the lower most point before frost forms on the evaporator surface, the second valve control devices closes the second valve (time $t_1$ elapsed). After time $t_1$, the first valve control devices solely controls the displacement of the compressor slant plate and maintains the suction chamber pressure slightly above P1. Immediately after time $t_1$, the heat load is still large so that a large amount of refrigerant gas flows from the evaporator to the suction chamber. As a result, some pressure loss occurs between the evaporator outlet portion and the suction chamber which makes the pressure of the evaporator outlet portion quickly rise. The quick pressure rise in the evaporator outlet portion causes inefficient heat exchange which in turn causes the room temperature to quickly rise.

Furthermore, when the above mentioned air conditioning system incorporates a mechanical thermal expansion valve which maintains super heat values associated with the evaporator outlet portion generally constant, hunting a suction refrigerant gas flow tends to occur due to a mutual interference between the control of the variable displacement mechanism and the control of the expansion valve immediately after $t_1$ shown in FIG. 9.

SUMMARY OF THE INVENTION

It is a primary object of this invention to eliminate a quick rising of the room temperature as a result of a quick rise in pressure in the evaporator outlet portion due to the pressure loss between the evaporator outlet portion and the suction chamber which occurs once the first valve control device achieves sole control of the variable displacement mechanism in a fresh air intake situation.

It is another object of this invention to eliminate hunting of suction refrigerant gas flow tending to happen due to the mutual interference between the control of the variable displacement mechanism and the control of the expansion valve once the first valve control device achieves sole control of the variable displacement mechanism.

The present invention is directed to a refrigerating system including a refrigerant circuit, comprising a condenser, evaporator and compressor. The compressor includes a compressor housing having a central portion, a front end plate at one end and a rear end plate at its other end. The housing has a cylinder block, a piston slidably fitted within each of the cylinders and a drive mechanism coupled to the pistons to reciprocate the pistons within the cylinders. The drive mechanism includes a drive shaft rotatably supported in the housing, a rotor coupled to the drive shaft and rotatable therewith, and a coupling mechanism for drivingly coupling the rotor to the pistons such that the rotary motion of the rotor is converted into reciprocating motion of the pistons. The coupling mechanism includes a member having a surface disposed at an incline angle relative to the drive shaft. The incline angle of the member is adjustable to vary the stroke length of the pistons and the capacity of the compressor. The rear end plate has a suction chamber and a discharge chamber. A variable displacement control mechanism controls angular displacement of the adjustable member and comprises a first valve control device for controlling fluid communication between the crank chamber and the suction chamber in response to changes in refrigerant pressure in the compressor. The first valve control device comprises a first passageway providing fluid communication between the crank chamber and the suction chamber and a first valve member for controlling the opening and closing of the first passageway to vary the capacity of the compressor by adjusting the incline angle. The first valve member comprises a first valve to directly open and close the first passageway. The variable displacement control mechanism further comprises a second valve control device for controlling fluid communication between the crank chamber and the suction chamber in response to a signal generated outside of the compressor. The second valve control device comprises a second passage providing fluid communication between the crank chamber and the suction chamber and a second valve member for controlling the opening and closing of the second passageway to vary the capacity of the compressor by adjusting the incline angle, the second valve member comprises a second valve to directly open and close the second passageway and override the operation of the first valve. A circuit for controlling the generation of the signal in response to thermodynamic characteristics related to the evaporator provides the compressor with external control of the variable displacement mechanism as compared to two boundary values of the thermodynamic characteristic.

The present invention is also directed to a method for varying the displacement of a slant plate compressor by sensing a thermodynamic characteristic related to the evaporator and selectively operating the second valve control device in comparison to the two boundary values.

Further objects, features and other aspects of the present invention will be understood from the detailed description of the preferred embodiment of the present invention with reference to the annexed drawings.

DETAILED DESCRIPTION OF THE PREFERRED EMBODIMENT

Figure 1:
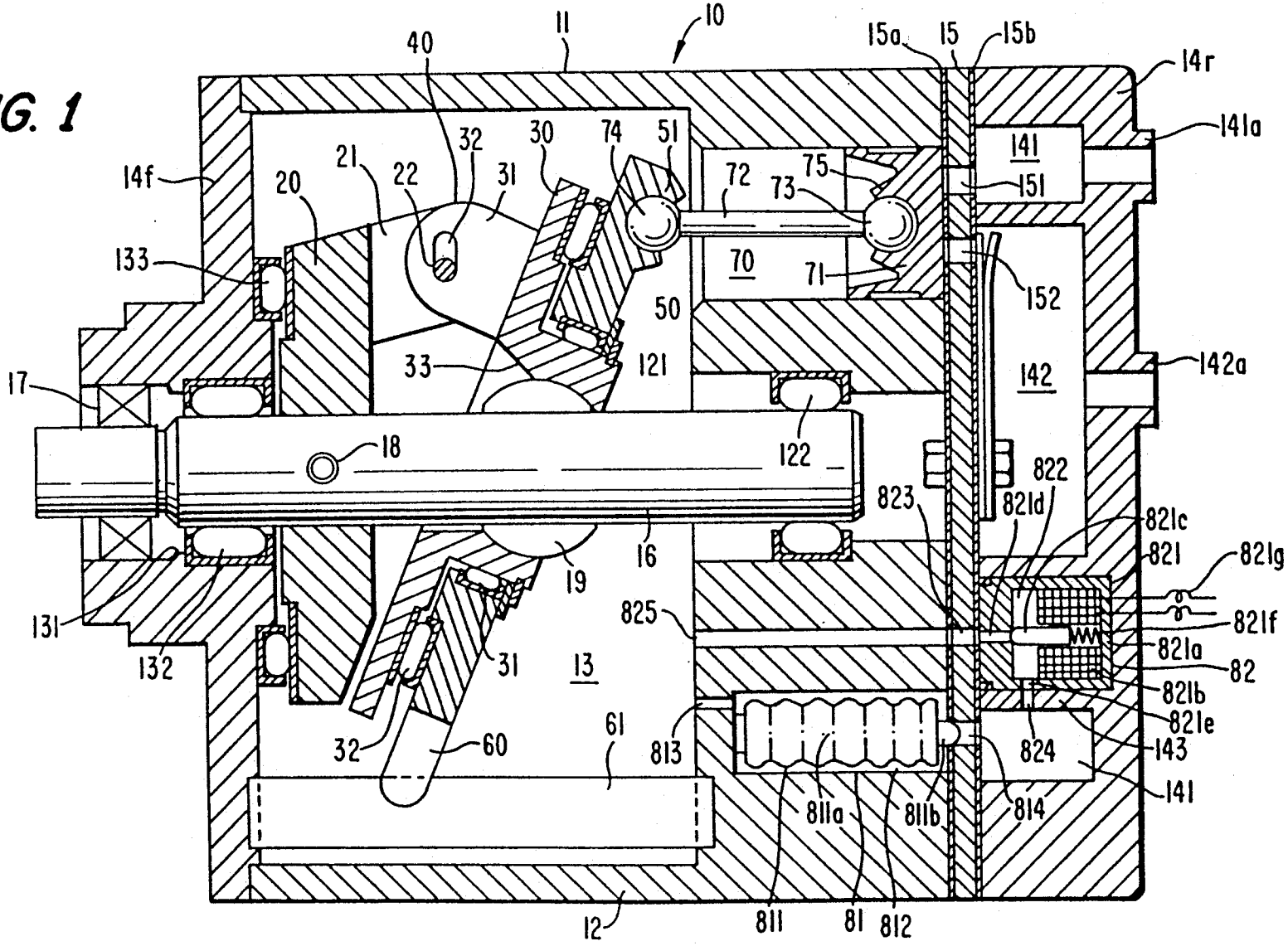
FIG. 1 is a vertical longitudinal sectional view of a wobble plate type compressor with a variable displacement mechanism in accordance with one embodiment of the present invention.

Referring to FIG. 1, a wobble plate type compressor 10 in accordance with one embodiment of the present invention is shown. Compressor 10 includes a closed cylindrical housing assembly 11 formed by a cylinder block 12, a crank chamber 13 within cylinder block 12, a front end plate **14*f* and a rear end plate 14*r***.

Front end plate **14*f* is mounted on the left end portion of crank chamber 13, as shown in FIG. 1, by a plurality of bolts (not shown). Rear end plate 14*r* and valve plate 15 are mounted on cylinder block 12 by a plurality of bolts (not shown). An opening 131 is formed in front end plate 14***f* for receiving a drive shaft 16 which is rotatably supported by front end plate 14*f* through bearing 132 which is disposed within opening 131. An inner end portion of drive shaft 16 is also rotatably supported by cylinder block 12 through bearing 122 which is disposed within a central bore 121. Central bore 121 provides a cavity in a center portion of cylinder block 12. Shaft seal 17 is disposed between an inner surface of opening 131 and an outer surface of drive shaft 16 at an outside of bearing 132. Thrust needle bearing 133 is disposed between an inner end surface of front end place 14*f* and an adjacent axial end surface of cam rotor 20.

Can rotor 20 is fixed on drive shaft 16 by pin member 18 which penetrates can rotor 20 and drive shaft 16. Cam rotor 20 is provided with arm 21 having a pin 22. Slant plate 30 has an opening 33 formed at a center portion thereof. Spherical bushing 19, slidably mounted on drive shaft 16, slidably mates with an inner surface of opening 33 which is spherically concave in shape. Slant plate 30 includes arm 31 having slot 32 in which pin 22 is inserted. Can rotor 20 and slant plate 30 are joined by hinged joint 40 including pin 22 and slot 32. Pin 22 is able to slide within slot 32 so that the angular position of slant plate 30 can be changed with respect to a longitudinal axis of drive shaft 16.

Wobble plate 50 is rotatably mounted on slant plate 30 through bearings 31 and 32. Rotation of wobble plate 50 is prevented by fork-shaped slider 60 which is attached to an outer peripheral end of wobble plate 50 and is slidably mounted on sliding rail 61 held between front end plate 14*f* and cylinder block 12. In order to slide slider 50 on sliding rail 61, wobble plate 50 wobbles without rotation even though cam rotor 20 rotates.

Cylinder block 12 has a plurality of annularly arranged cylinders 70 in which respective pistons 71 slide. All pistons 71 are connected to wobble plate 50 by a corresponding plurality of connecting rods 72. Ball 73 at one end of rod 72 is received in socket 75 of pistons 71, and ball 74 at the other end of rod 72 is received in socket 51 of wobble plate 50. It should be understood that, although only one such ball socket connection is shown in the drawings, there are a plurality of sockets arranged peripherally around wobble plate 50 to receive the balls of various rods 72, and that each piston 71 is formed with a socket for receiving the other ball of rods 72.

Rear end plate 14*r* is shaped to define suction chamber 141 and discharge chamber 142. Valve plate 15, which is fastened to the end of cylinder block 12 by a plurality of screws (not shown) together with rear end plate 14*r*, is provided with a plurality of valved suction ports 151 connected between suction chamber 141 and respective cylinders 70, and a plurality of valved discharge ports 152 connected between discharge chamber 142 and respective cylinders 70. Suitable need valves for suction ports 151 and discharge ports 152 are described in U.S. Pat. No. 4,011,029 issued to Shimizu. Gaskets 15*a* and 15*b* are placed between cylinder block 12 and an inner surface of valve plate 15, and an outer surface of valve plate 15 and rear end plate 14*r*, to seal the matting surfaces of cylinder block 12, valve plate 15 and rear end plate 14*r*. Suction inlet port 141*a* and discharge outer port 142*a* are formed at rear end plate 14*r* and connect to an external fluid circuit.

A variable displacement actuation mechanism comprises a first valve control device 81 and a second valve control device 82. The devices actuate the displacement of slant plate 30 with respect to drive shaft 16.

First valve control device 81 includes a bellows valve 811 which is disposed within chamber 812 formed in cylinder block 12. Chamber 812 is connected to crank chamber 13 through a hole or passage 813 formed in cylinder block 12, and is also connected to suction chamber 141 through a hole or passage 814 formed in valve plate 15. Hole 813, chamber 812 and hole 814 provide fluid communication between crank chamber 13 and suction chamber 141. Bellows valve 811 comprises bellows element 811*a* of which one end is attached to an inner end surface of chamber 812, and a needle valve element 811*b* which is attached to the other end of bellows element 81*a* in order to face hole 814. Bellows element 811*a* is axially expanded and contracted in response to crank chamber pressure thereby causing needle valve element 811*b* to close and open hole 814 to keep the crank chamber pressure generally constant. Accordingly, first valve control device 81 controls fluid communication between crank chamber 13 and suction chamber 141 to keep the crank chamber pressure generally constant in response to changes in the crank chamber pressure. When the crank chamber pressure is kept constant, the suction chamber is also kept generally constant.

Second valve control device 82 includes solenoid valve 821 which is disposed within control chamber 822 formed in rear end plate 14*r*. Solenoid valve 821 comprises a casing 821*a* which encases control chamber 822, electromagnetic coil 821*b* and needle valve element 821*c*. Electromagnetic coil 821*b* surrounding needle valve element 821*c* is disposed within casing 821*a*. Holes 821*d* and 821*e* are formed in casing 821*a*. Hole 821*d* is formed at a top portion of casing 821*a* and faces later mentioned hole 823. Hole 821*e* is formed at a lower side wall portion and faces a hole 824 formed at partition wall 143. Needle valve element 821*c* is urged toward hole 821*d* by restoring force of bias spring 821*f*. A wire 821*g* conducts a later mentioned signal generated at a location outside the compressor to electromagnetic coil 821*b*. Hole 823 is formed in valve plate 15 and connects hole 821*d* and a conduit 825 formed in cylinder block 12. Therefore, crank chamber 13 is in fluid communication with control chamber 822 through conduit 825, hole 823 and hole 821*d*. Control chamber 822 communicates with suction chamber 141 through hole 821*e* and hole 824. When the external signal does not energize electromagnetic coil 821*b*, needle valve element 821*c* closes hole 821*d* by virtue of the restoring force of bias spring 821*f* so that the communication between crank chamber 13 and suction chamber 141 is blocked. When the external signal energizes electromagnetic coil 821*b*, needle valve element 821*c* moves right in viewing FIG. 1 and against the restoring force of bias spring 821*f* so that crank chamber 13 communicates with suction chamber 141 via conduit 825, hole 823, hole 821*d*, control chamber 822, hole 821*e* and hole 824. When communication between crank chamber 13 and suction chamber 141 is established through conduit 825 by the operation of second valve control device 82, the operation of first valve control device 81 is overridden.

Furthermore, the construction of solenoid valve 821 may be modified in a manner such that the closing of needle valve element 821*c* is retarded by spring 821*f*. According, the external signal would have to be reversed to appropriately actuate the valve.

Figure 2:
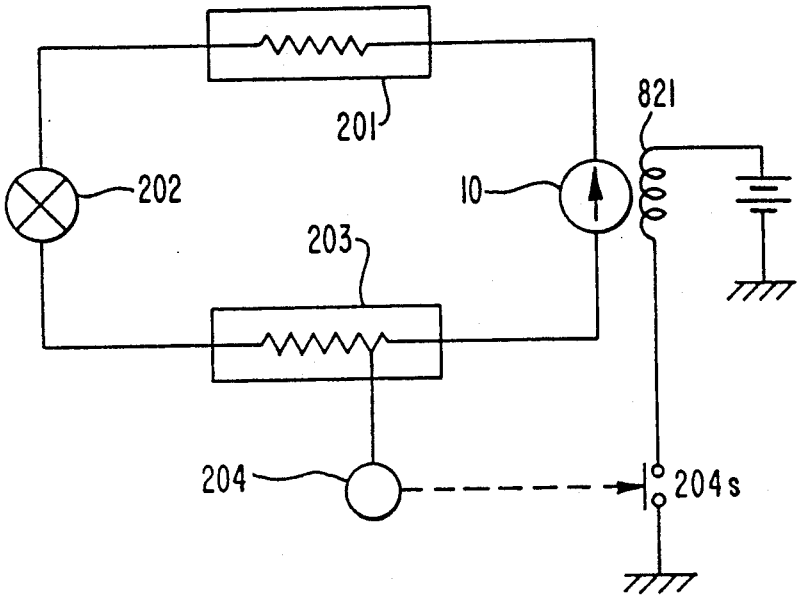
FIG. 2 is a schematic block diagram of one refrigerating circuit including the compressor shown in FIG. 1.

Referring to FIG. 2, a schematic block diagram of one refrigerating circuit including the compressor depicted in FIG. 1 is shown. A refrigerant gas compressed by compressor 10 flows into a condenser 201 where it is condensed. The condensed refrigerant flows into evaporator 203 after passing through expansion valve 202. After passing through evaporator 203, the evaporated gas returns to compressor 10. A pressure actuation device 204 includes switch 204*s* and works in response to the sensed pressure in the outlet portion of evaporator 203 (a thermodynamic characteristic related to the evaporator).

The operation of pressure actuation device 204 will be described hereafter. When R14 is selected as a refrigerant, pressure device 204 is set to close pressure device switch 204*s* when the pressure in the evaporator outlet portion is sensed to be or reaches (i.e., is greater than or equal to) 2.3 kg/cm$^2$.G, wherein G is gauge pressure, so that an "on" signal is sent to solenoid valve 821 of second valve control device 82. The signal energizes electromagnetic coil 821*b* thereby opening the solenoid valve and causing maximum displacement of slant plate 30 so that maximum compression is achieved. On the other hand, pressure device 204 is also set to open switch 204*s* when the pressure in the evaporator outlet portion is sensed to fall to (or below) 2.1 kg/cm$^2$.G, which is the lower most point before frost forms on the evaporator surface. As a result, an "off" signal is sent to solenoid valve 821 of second valve control device 82. The signal deenergizes electromagnetic coil 821*b* thereby closing the solenoid valve, allowing slant plate 30 to retract from maximum displacement and preventing frost formation on the evaporator surface.

Figure 4:
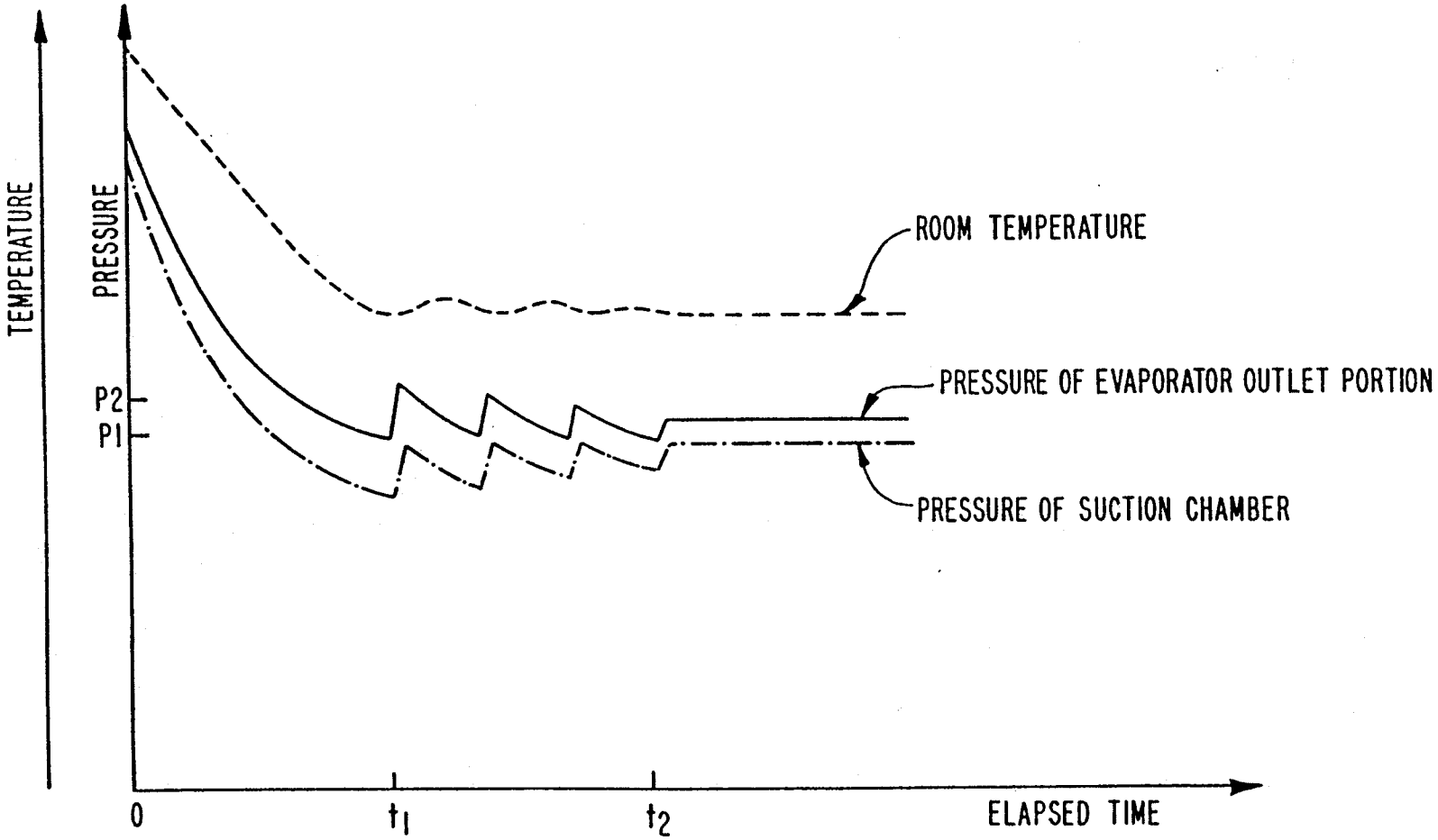
FIG. 4 is a graph showing cool down characteristics of the refrigerant circuits shown in FIG. 2 or FIG. 3.

Referring to FIG. 4, the cool down characteristics of the above mentioned refrigerating circuit during the air conditioning process using fresh air intake, will be described hereafter, in FIG. 4, the solid line, dotted line and dashed line show the pressure in the evaporator outlet portion, the pressure of the compressor suction chamber and room (e.g., automotive passenger compartment) temperature, respectively. When the passenger compartment provides a high heat load, which, for example, commonly occurs after the automobile has been left unattended for a while during summer, and the air conditioning system is then turned on, pressure devices 204 subsequently actuates pressure device 204*s* to send an "on" signal to solenoid valve 821 due to the pressure in evaporator outlet portion reaching or being above 2.3 kg/cm$^2$.G, which is indicated as P2. Accordingly, electromagnetic coil 821*b* is energized so that needle valve element 821*c* opens hole 821*d* to communicate crank chamber 13 and suction chamber 141. As a result, compressor 10 operated with slant plate 30 at a maximum slant angle, i.e., with maximum displacement, so that the pressure in the evaporator outlet portion and the pressure in the suction chamber fall quickly as shown in FIG. 4 up to time $t_1$. When the pressure in the evaporator outlet portion falls to 2.1 kg/cm$^2$.G, which is indicated as P1, (time $t_1$ has elapsed) pressure device 204 deactivates pressure device switch 204*s* so than an "off" signal is sent to solenoid valve 821. Accordingly, electromagnetic coil 821*b* deenergizes so that needle valve element 821*c* closes hole 821*d* to block the communication between crank chamber 13 and suction chamber 141. After closing hole 821*d*, first valve control device 81 solely controls communication between crank chamber 13 and suction chamber 141 in response to changes in crank chamber pressure while keeping suction chamber pressure generally at 2.0 kg/cm$^2$.G. Even if the suction chamber pressure is kept at 2.0 kg/cm$^2$.G, the pressure at the evaporator outlet may exceed 2.3 kg/cm$^2$.G, regardless of pressure loss between the evaporator and compressor which occurs during large heat loads, i.e., when the air to be cooled is at a relatively high temperature. When the pressure of evaporator outlet portion is sensed to exceed 2.3 kg/cm$^2$.G again, pressure device switch 204*s* is actuated so as to excite electromagnetic coil 821*b*. As a result, the pressure in the evaporator outlet portion and the pressure in the suction chamber fall quickly as shown in FIG. 4 between $t_1$ and $t_2$. When the pressure in the evaporator outlet portion falls to 2.1 kg/cm$^2$.G, pressure device switch 204 cuts off the "on" signal so as to release the excitation of electromagnetic coil 821*b*. Once more, first valve control device 81 controls the compressor crank chamber and suction-pressures. The above mentioned process is continuously repeated until the pressure in the evaporator outlet portion does not rise to 2.3 kg/cm$^2$.G when first valve control device 81 is solely controlling the compressor pressures. In FIG. 4, elapsed time $t_2$ shows the end of the repeated process, i.e., the on-off signal cycles. After $t_2$, first valve control device 81 solely and continuously control the compressor crank chamber and suction pressures. First valve control device 81 is set to keep or stabilize the suction chamber at a level above the refrigerant pressure level where frost would from on the evaporator, but below P1. This assures that the refrigerant pressure at the evaporator outlet does not rise to an unacceptable cooling level when the override function of the second control device ceases (after $t_2$).

Figure 3:
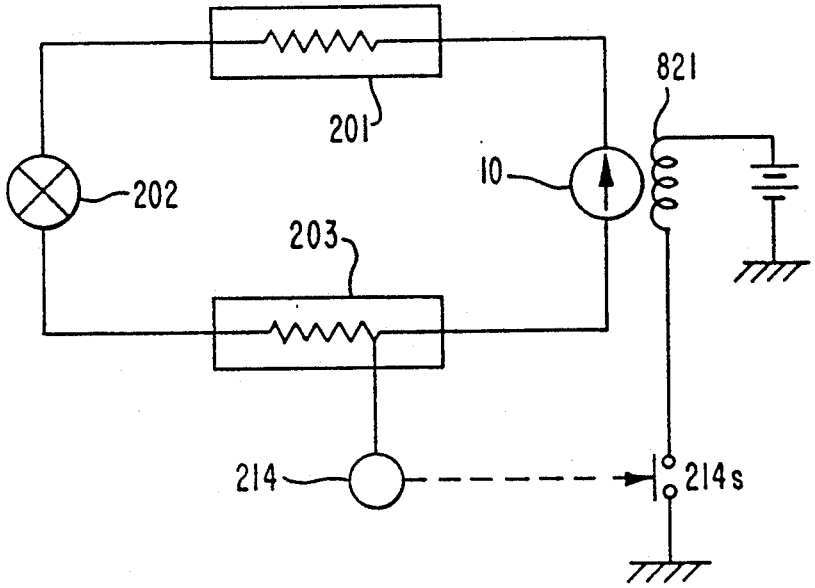
FIG. 3 is a schematic block diagram of another refrigerating circuit including the compressor shown in FIG. 1.

Referring to FIG. 3, another refrigerating circuit including the compressor depicted in FIG. 1 is shown. In this refrigerating circuit, a thermal device 214 is used insteads of pressure device 204 of FIG. 2. Thermal device 214 includes switch 214*s* to send "on" or "off" signals to solenoid valve 821 of second valve control device 82 in response to the temperature of the air leaving evaporator 203 (another thermodynamic characteristic related to the evaporator). For example, when the temperature reaches 4° C., thermal device 214 actuates switch 214*s* so as to send an "on" signal to solenoid valve 821. On the other hand, when the temperature falls to 1° C., thermal device switch 214*s* causes an "on" signal to be sent to solenoid valve 821.

In the above mentioned embodiments shown in FIGS. 2 and 3, second valve control device 82 works in response to the pressure in the outlet portion of evaporator 203 and the temperature of the air leaving evaporator 203, respectively, as the thermodynamic characteristic related to evaporator 203. However, other thermodynamic characteristics related to evaporator 203 can be used for operating second valve control device 82, for example, heat load at evaporator 203, the temperature of air approaching evaporator 203, the temperature of refrigerant within the outlet portion of evaporator 203 and the surface temperature of a fin of evaporator 203.

Furthermore, all these thermodynamic characteristics related to evaporator 203 have certain relations to one another through formulas or equations.

Figure 5:
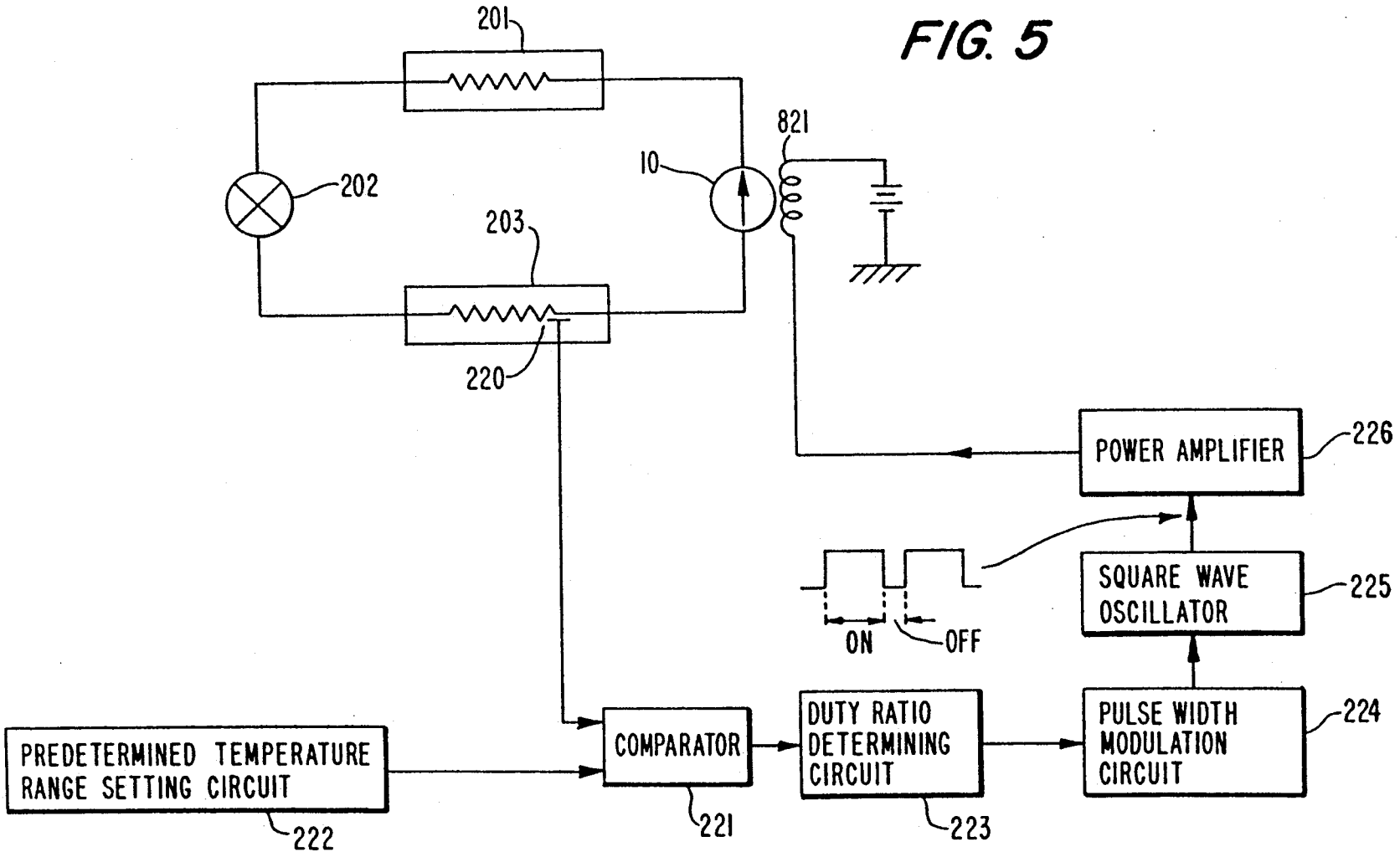
FIG. 5 is a schematic block diagram of still another refrigerating circuit including the compressor shown in FIG. 1.

Referring to FIG. 5, still another refrigerating circuit including compressor 10 of FIG. 1 is shown. This refrigerating circuit comprises a control circuit 221–226 responsive to sensing circuits 220 and 222 to control the "on" time of solenoid valve 821. The only cycle (time period when valve 821 is on) for solenoid valve 821 is controlled in accordance with the stepwise duty ratio determination of FIG. 6 in addition to the on-off control depicted in the functions of refrigerating circuits shown in FIGS. 2 and 3.

Figure 6:
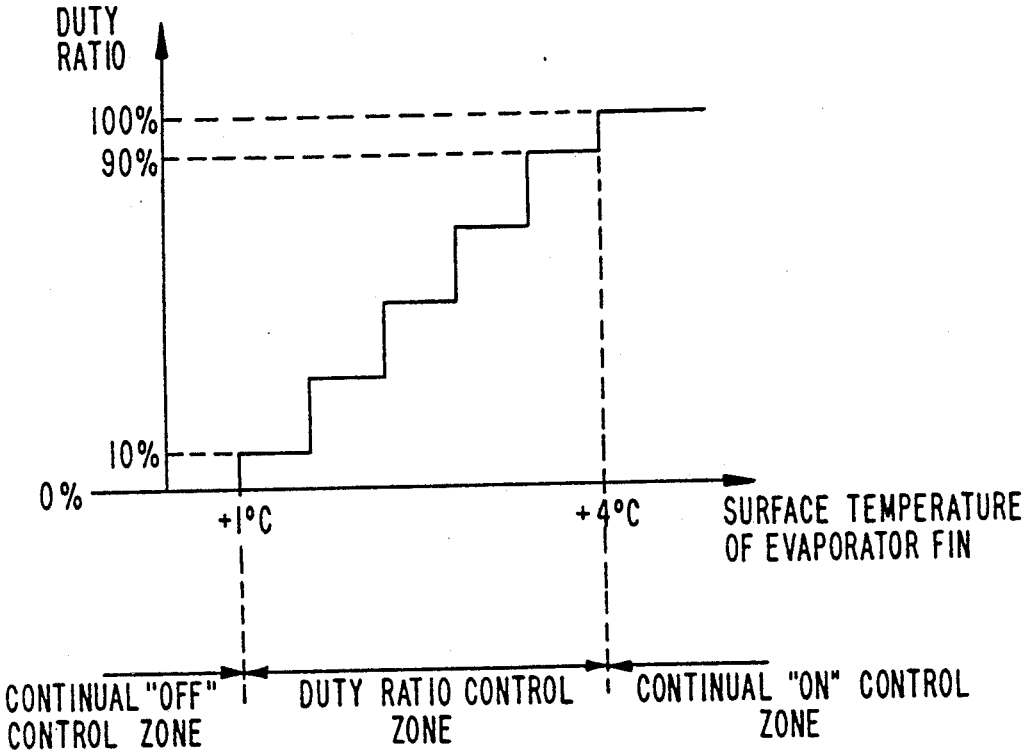
FIG. 6 is a diagram showing various control stages of the solenoid valve corresponding to the control circuit shown in FIG. 5 in response to a surface temperature of an evaporator fin.

A control of the duty ratio in the refrigerating circuit of FIG. 5 will be described hereafter. One outer signal which indicates a measured surface temperature of a fin of evaporator 203 sensed by thermal sensor 220 is sent to comparator 221 as a first input signal thereof. A predetermined temperature range setting circuit produces a second input signal which represents a range from 4° C. as the upper limit value to 1° C. as the lower limit value, for example, in 0.6° C. steps. Comparator 221 compares the first input signal to one of the steps of the range of second input signals, and sends a signal which indicates that the first input signal is within the stepwise range of the second input signal and an output is provided of the determination to duty ratio decision circuit 223. Circuit 223 decides an appropriate duty cycle for solenoid valve 821 as follows. Referring to FIG. 6, when the first input signal is within the predetermined range of 1° to 4° C., the duty ratio is determined by the depicted stepwise curve which provides a duty ratio which decreases in accordance to the decreasing temperature value of the first input signal as shown. An output signal relating to the appropriate duty ratio is produced in circuit 223 and is provided to a pulse width modulation circuit 224. Pulse width modulation circuit 224 produces a control signal for controlling wave modulation circuit 224 produces a control signal for controlling wave oscillator 225 to provide a pulse stream having a predetermined width in accordance with the signal from circuit 223. The pulse stream provided by square wave oscillator 225 is amplified by a power amplifier, and provides for controlling the duty cycle of solenoid valve 821. Solenoid valve 821 receives an "on" signal during pulse peaks.

Figure 7:
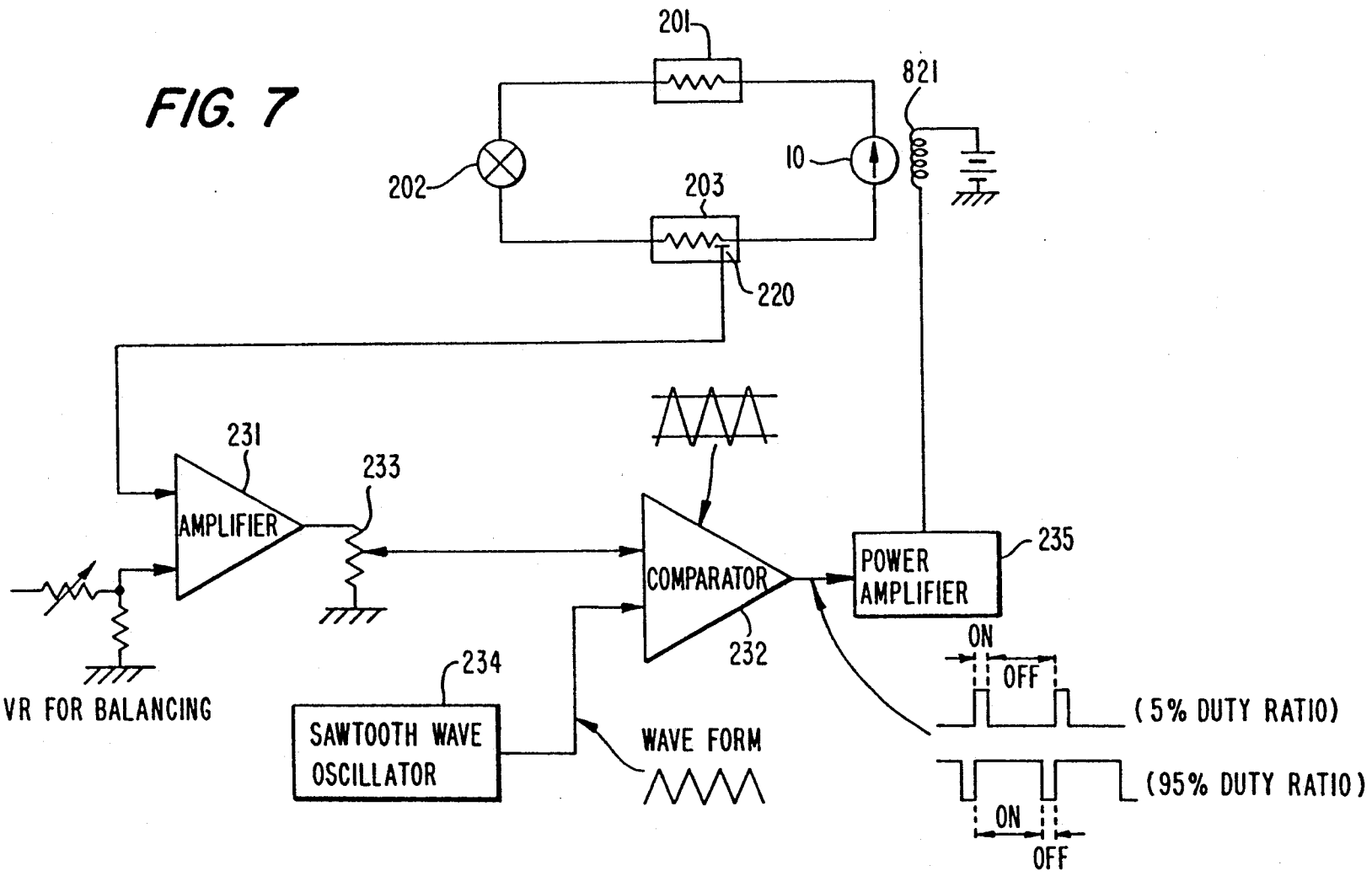
FIG. 7 is a schematic block diagram of yet another refrigerating circuit including the compressor shown in FIG. 1.
Figure 9:
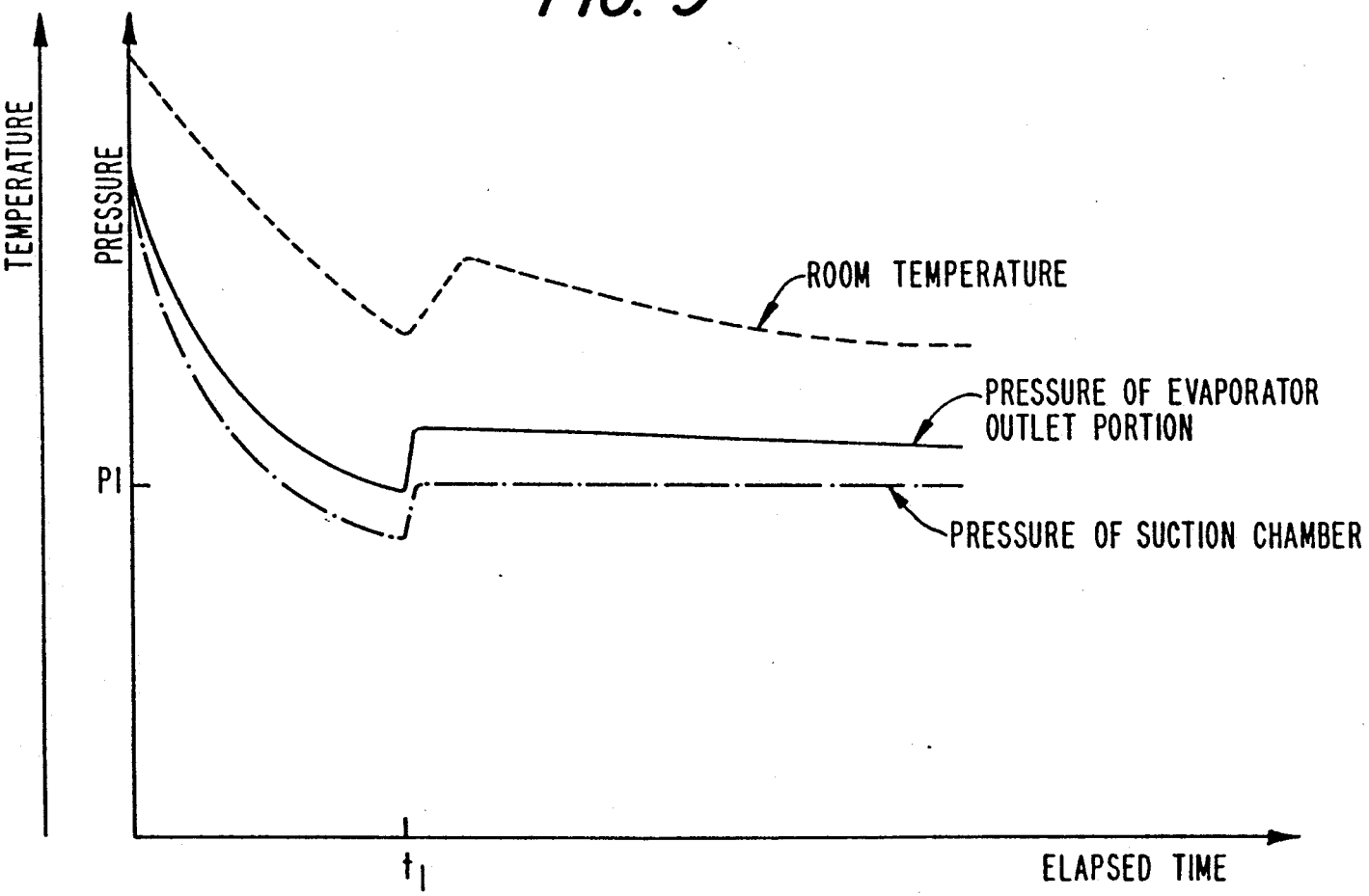
FIG. 9 is a graph showing cool down characteristics of a refrigerant circuit including a known variable displacement wobble plate type compressor.

Referring to FIG. 7, yet another refrigerating circuit including the compressor shown in FIG. 1 is shown. In this refrigerating circuit, "on" time (duty cycle) of solenoid valve 821 is controlled by a duty ratio in response to a signal similar to the control signal for the refrigerating circuit shown in FIG. 5. However, in this embodiment, the duty ratio in this refrigerating circuit is determined from a continuous curve according to FIG. 8.

Figure 8:
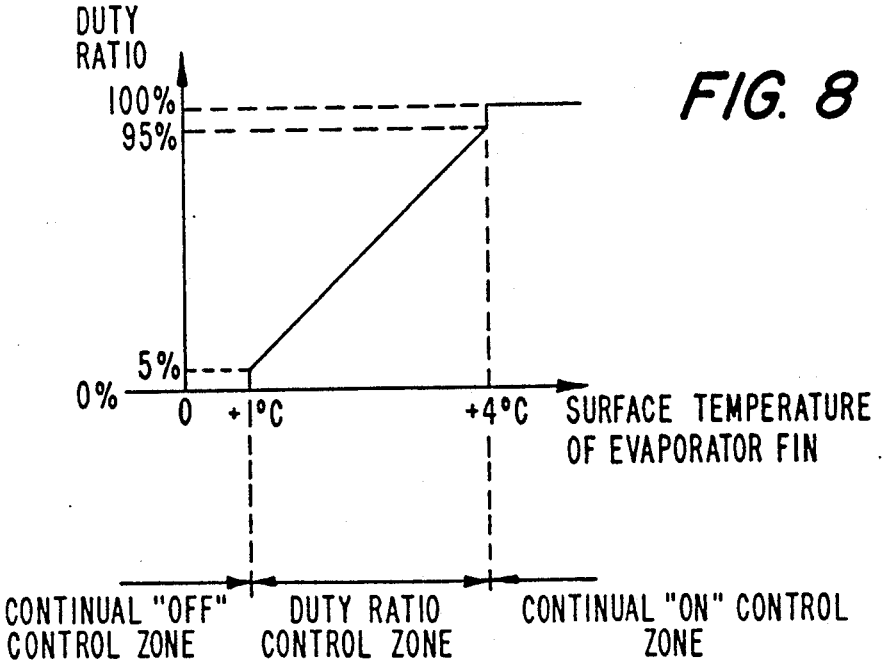
FIG. 8 is a diagram showing various control stages of the solenoid valve corresponding to the control circuit shown in FIG. 7 in response to the surface temperature of the evaporator fin.

Thus, a control of the duty ratio of this refrigerating control circuit may be described as follows. The first signal which represents the surface temperature of the fin of evaporator 203 sensed by thermal sensor 220 is transmitted to amplifier 231 for amplification. The amplified sensor signal is sent to a comparator 222 through a variable resistor 233. A sawtooth wave provided by a sawtooth wave oscillator 234 is sent to the comparator and is sliced by the amplified sensor signal. A slicing level is proportionate to an intensity of the first signal so that various pulses are produced at the output of comparator 232 in accordance to the intensity of the first signal. In addition, the slicing level is adjusted by variable resistor 233. The pulse produced by comparator 232 is amplified by a power amplifier, and sent to solenoid valve 821. Solenoid valve 821 receives an "on" signal during pulse peaks of the provided output pulse stream of comparator 232. Further, it is well known to produce various width pulses indicating different duty ratios by slicing a sawtooth wave. One example of a duty radio control of solenoid valve 821 in this refrigerating circuit is shown in FIG. 8. In this example, the duty ratio of the output of comparator 232 is set at 0% when the surface temperature of the evaporator fin is under the lower limit value (+1° C.), and is set at 100% when the surface temperature is over the upper limit value (+4° C.) and then is set in the range of 5% to 95% continuously when the surface temperature is between the lower limit value and the upper limit value.

A refrigerating circuit in which solenoid valve 821 is controlled by only continuously "on" or "off" signals, as shown in FIGS. 2 and 3, is suitable for the variable displacement compressor in which the variable displacement mechanism works slowly in response to changes in the heat load. On the other hand, a refrigerating circuit in which solenoid valve 821 is controlled by a duty ratio control circuit as shown in FIGS. 5 or 7 is suitable for the variable displacement compressor in which the variable displacement mechanism works quickly in response to changes in the heat load.

Furthermore, in the above mentioned embodiments, a device which controls the fluid communication path between the crank chamber and the suction chamber in response to the crank chamber pressure is used for the first valve control device. However, the present invention allows use of other types of devices as the first valve control device. For instance, a device which controls the fluid communication path between the crank chamber and the suction chamber in response to the suction pressure may be used.

The present invention has been described in detail in connection with preferred embodiments. These embodiments, however, are merely for example only and the invention is not restricted thereto. It will be easily understood by those skilled in the art that variations and modifications can easily be made within the scope of this invention as defined by the appended claims.

I claim:

1. In a refrigerating system including a refrigerant circuit, comprising a condenser, evaporator and compressor, the compressor including a compressor housing having a central portion, a front end plate at one end and a rear end plate at its other end, said housing having a cylinder block, a piston slidably fitted within each of said cylinders, a drive mechanism coupled to said pistons to reciprocate said pistons within said cylinders, said drive mechanism including a drive shaft rotatably supported in said housing, a rotor coupled to said drive shaft and rotatable therewith, and coupling means for drivingly coupling said rotor to said pistons such that the rotary motion of said rotor is converted into reciprocating motion of said pistons, said coupling means including a member having a surface disposed at an incline angle relative to said drive shaft, said incline angle of said member being adjustable to vary the stroke length of said pistons and the capacity of said compressor, said rear end plate having a suction chamber and a discharge chamber, variable displacement control means for controlling angular displacement of said adjustable member, said variable displacement control means comprising first valve control means for controlling fluid communication between said crank chamber and said suction chamber in response to changes in refrigerant pressure in said compressor, said first valve control means comprising a first passageway providing fluid communication between said crank chamber and said suction chamber and first valve means for controlling the opening and closing of said first passageway to vary the capacity of the compressor by adjusting the incline angle, said first valve means comprising a first valve to directly open and close said first passageway, said variable displacement control means further comprising second valve control means for controlling fluid communication between said crank chamber and said suction chamber in response to a control signal generated outside of the compressor, said second valve control means comprising a second passageway providing fluid communication between said crank chamber and said suction chamber and second valve means for controlling the opening and closing of said second passageway in response to the control signal to vary the capacity of said compressor by adjusting the incline angle, said second valve means comprising a second valve to directly open and close said second passageway and override the operation of said first valve, the improvement comprising:

first control means for controlling the generation of the control signal in response to the temperature of refrigerant within the outlet portion of the evaporator such that the control signal is generated when the temperature of refrigerant within the outlet portion of the evaporator indicates a value beyond a first predetermined range of values; and second control means for controlling the duty ratio of said second valve control means in response to the magnitude of said generated control signal such that the controlled duty ratio is proportional to the magnitude of said generated control signal.

* * * * *